US010881177B2

(12) United States Patent
Boothman et al.

(10) Patent No.: US 10,881,177 B2
(45) Date of Patent: Jan. 5, 2021

(54) FOLDABLE BAG

(71) Applicant: GYRE B.V., Amsterdam (NL)

(72) Inventors: Joanna Boothman, Amsterdam (NL); Joost Alle De Muinck Keizer, Amsterdam (NL)

(73) Assignee: GYRE B.V., Amsterdam (NL)

( * ) Notice: Subject to any disclaimer, the term of this patent is extended or adjusted under 35 U.S.C. 154(b) by 0 days.

(21) Appl. No.: 16/483,787

(22) PCT Filed: Feb. 6, 2018

(86) PCT No.: PCT/NL2018/050083
§ 371 (c)(1),
(2) Date: Aug. 6, 2019

(87) PCT Pub. No.: WO2018/147730
PCT Pub. Date: Aug. 16, 2018

(65) Prior Publication Data

US 2019/0357646 A1 Nov. 28, 2019

(30) Foreign Application Priority Data

Feb. 7, 2017 (NL) ..... 2018330

(51) Int. Cl.
*A45C 7/00* (2006.01)
*A45C 3/04* (2006.01)

(52) U.S. Cl.
CPC ..... *A45C 7/0077* (2013.01); *A45C 3/04* (2013.01)

(58) Field of Classification Search
CPC ..... A45C 7/0077; A45C 3/04; B65D 29/00; B65D 31/10
USPC ..... 383/2, 8, 10, 120
See application file for complete search history.

(56) References Cited

U.S. PATENT DOCUMENTS 1,898,838 A * 2/1933 Katz ..... B65D 33/12 383/2
2,610,071 A * 9/1952 Davis ..... B62B 1/12 280/652
3,142,324 A * 7/1964 Fremont ..... A45C 7/0077 383/120
3,144,931 A 8/1964 Long
(Continued)

FOREIGN PATENT DOCUMENTS

JP S49146021 U 12/1974
JP H0518316 A 3/1993
(Continued)

OTHER PUBLICATIONS

International Search Report and Written Opinion for the International Patent Application No. PCT/NL2018/050083, dated Apr. 25, 2018, 22 pages.

*Primary Examiner* — Jes F Pascua

(57) ABSTRACT

A bag, in particular a foldable bag, comprises a tube having a closed end and an open end. The tube is of a fabric and includes at least one set of pleats. The at least one set of pleats includes at least five parallel longitudinal folds in alternating directions that extend from the closed end to the open end of the tube. The longitudinal folds of the at least one set of pleats are secured in place at the closed end of the tube. The sections of fabric on opposite sides of each longitudinal fold are arranged the one on top of the other in a folded state of the at least one set of pleats.

16 Claims, 11 Drawing Sheets

(56) References Cited

U.S. PATENT DOCUMENTS

| | | | | | |
|---|---|---|---|---|---|
| 4,782,874 | A * | 11/1988 | Chartier | A45C 7/0077 | 150/112 |
| 5,580,173 | A * | 12/1996 | Sebastian | B65D 31/10 | 383/76 |
| 7,775,717 | B2 * | 8/2010 | DeLuca | B65F 1/062 | 383/120 |
| 2004/0022456 | A1 * | 2/2004 | Hanson | B65D 33/02 | 383/8 |
| 2011/0235950 | A1 * | 9/2011 | Lin | A45C 7/0077 | 383/105 |
| 2014/0147059 | A1 * | 5/2014 | Tan | B65D 33/001 | 383/7 |
| 2018/0242703 | A1 * | 8/2018 | Singh | A45C 7/0077 | |

FOREIGN PATENT DOCUMENTS

| | | | | | |
|---|---|---|---|---|---|
| JP | 2010143642 | A | | 7/2010 | |
| JP | 2015058343 | A | * | 3/2015 | |
| WO | WO-2015134446 | A1 | * | 9/2015 | B65D 33/001 |
| WO | WO-2020050210 | A1 | * | 3/2020 | A45C 7/00 |

* cited by examiner

FIG. 4B
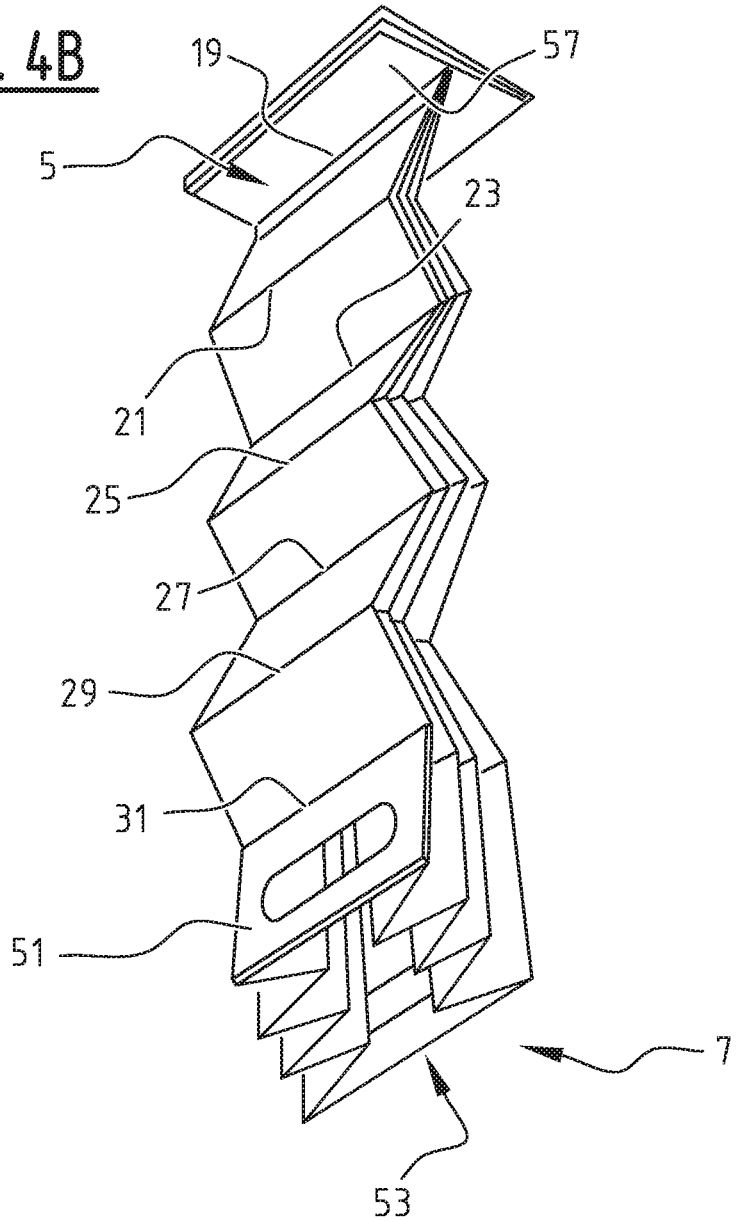
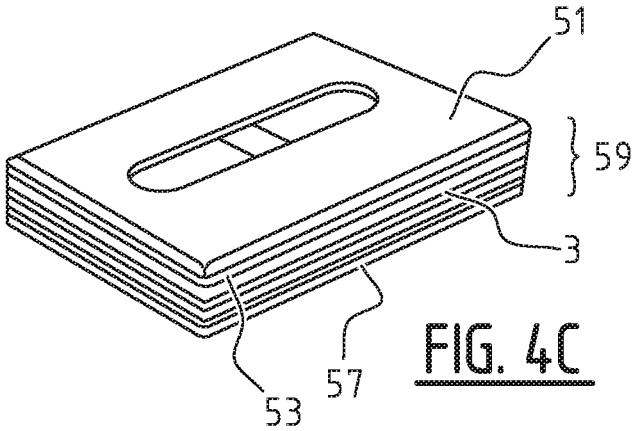
FIG. 4C

FOLDABLE BAG

This is a national stage application filed under 35 U.S.C. § 371 of pending international application PCT/NL2018/050083 filed Feb. 6, 2018, which claims priority to Netherlands Patent application NL 2018330, filed Feb. 7, 2017, the entirety of which applications are hereby incorporated by reference herein.

The present invention relates to a bag, in particular a foldable bag.

When shopping, the problem arises how to take the bought products home. As a solution to this problem it is known that shops provide shoppers with so-called carrier bags in which bought products are put such that the bought products can conveniently be taken home by carrying the bag. Generally shops provide disposable carrier bags made of polymer films or carton sheets that are intended and designed for single use. Such disposable carrier bags are generally considered environmentally unfriendly, in particular due to their single use character. In view thereof shops started to provide or sell carrier bags made of fabric that are intended for multiple use. Although such carrier bags made of fabric do allow shoppers to make multiple use of the carrier bag, the problem arises that shoppers tend to forget to bring the fabric carrier bag with them shopping or even leave the fabric carrier home intentionally because it is inconvenient to carry around an empty fabric carrier bag. In order to address this problem of fabric carrier bags, shops started to sell foldable carrier bags. Such foldable carrier bags are generally sold folded into a small package that is arranged in a small storage bag. The small storage bag is of such a size that it can conveniently be put in a purse or pocket of a jacket or trousers. This makes carrying the fabric carrier bag around empty more convenient. Shoppers can carry the empty fabric carrier bag around in their purse or in a pocket of their jacket or trousers and take the folded fabric carrier bag out of the purse or pocket when the shopper needs a carrier bag for carrying bought products. Drawback of known foldable fabric carrier bags is that after unfolding and using the carrier bag for carrying products, it takes considerable effort to refold the carrier bag into a small package that fits in the small storage bag in which the foldable carrier bag was originally stored. In practise, even if trying their best, most shoppers do not succeed in refolding the foldable fabric carrier bag into a package that is even close to the size in which it was originally sold. As a result, the refolded carrier bag does no longer conveniently fit their purse or a pocket of their jacket or trousers, and again is (un-)intentionally left home. Furthermore, repeatedly unfolding and refolding the carrier bag according to each time an alternative folding pattern likely results in a visually less appealing bag that shows a random pattern of remnants of previous fold lines.

JP H05 18316 U is considered the closest prior art. French patent applications FR 1463187 A and FR 2887531 A1, U.S. Pat. Nos. 4,782,874 A and 3,144,931 A, as well as the Chinese publication CN 201563793 U, are acknowledged as further prior art.

The present invention has among others as its objective to provide an improved foldable fabric carrier bag.

Thereto the present invention provides a bag comprising a tube having a closed end and an open end, wherein the tube is of a fabric, preferably a pleatable fabric. The tube comprises at least one set of pleats, wherein the at least one set of pleats comprises at least five parallel longitudinal folds in alternating directions that extend from the closed end to the open end of the tube. The longitudinal folds of the at least one set of pleats are secured in place at the closed end of the tube, wherein the sections of fabric on opposite sides of each longitudinal fold are arranged the one on top of the other in a folded state of the at least one set of pleats. Preferably, the tube is provided at its open end with at least one handle for carrying the bag.

When refolding the bag according to the invention, the feature of the longitudinal folds of the set of pleats being secured in place at the closed end of the tube, wherein the sections of fabric on opposite sides of each longitudinal folds are arranged the one on top of the other in a folded state of the at least one set of pleats, helps to fold the fabric tube in correspondence with the original folding pattern. The longitudinal folds easily align, e.g. under the influence of gravity when the bag is held upside down. In other words, the folding pattern of the longitudinal folds is defined at the closed end of the tube, such that when refolding the bag it takes little effort to fold the carrier bag in accordance with the original folding pattern that provided the fabric carrier bag with its original small size in folded state. This is a great advantage over previously known foldable carrier bags, where the original folding pattern that provided the fabric carrier bag with its original small size in folded state, is difficult to reproduce. Furthermore, by helping to fold the fabric tube in correspondence with the original folding pattern, the bag according to the invention helps to prevent a less appealing appearance of the bag as a result of a random pattern of remnants of previous fold lines even after repeatedly unfolding and refolding the bag according to the invention.

In an advantageous embodiment of the bag according to the invention, the fabric has a weight that is such that when the tube is suspended from its closed end with the open end pointing downwards, the at least one set of pleats is pulled under influence of gravity into its folded state along the length of the tube from the closed end to the open end. This feature allows for conveniently folding the set of pleats into its folded state in accordance with the original folding pattern by simply suspending the tube from its closed end with the open end pointing downwards.

In a further advantageous embodiment of the bag according to the invention, the folds comprise set folds. Set folds, also referred to as permanent folds, remain in place when the folded fabric is repeatedly unfolded and refolded. Such set folds in fabric are for instance used in trousers for providing creases. Preferably the set folds in the bag according to the invention are at least one of heat-set folds, chemically-set folds, and mechanically set folds. The fabric of the tube of the bag according to the invention is preferably suitable for heat-setting of folds, chemically-setting of folds, or mechanically setting of folds. A fabric that is found to be particularly suitable as the fabric for the tube of the bag according to the present invention is organza. Organza is a thin fabric, such that in the folded state of the set of pleats, the thickness of the stack of fabric sections arranged the one on top of the other can be relatively thin. Furthermore, organza is suitable for setting folds. By being thin and suitable for setting folds, organza is particularly suitable as fabric for the tube of the bag according to the present invention. Preferably the fabric is organza woven with synthetic fibers, preferably polyester, referred to as polyester organza, or nylon, referred to as nylon organza. Organza woven with synthetic fibers is particularly suitable for applying heat-set folds. Polyester organza is most preferred as the fabric for the tube of the bag according to the invention. PLA organza may be used as an environmentally less harmful alternative for polyester organza.

The set of pleats of the bag according to the invention, comprising at least five parallel longitudinal folds in alternating directions that extend from the closed end to the open end of the tube, wherein in the folded state the sections of fabric on opposite sides of each longitudinal folds are arranged the one on top of the other, provide in the folded state for a reduction of the size of the tube in the direction transverse to the longitudinal folds of the set of pleats.

In an advantageous embodiment of the bag according to the invention the bag comprises two sets of pleats that extend from the closed end to the open end of the tube, wherein along the cross-sectional circumference of the tube the two sets of pleats are separated on either side by a respective un-pleated section of fabric that extends between the respective end folds of the sets of pleats. In the folded state this provides two juxtaposed stacks of fabric sections arranged between the two un-pleated sections of fabric. Furthermore, in the folded state, a reduction of the size of the tube in the direction transverse to the longitudinal folds of the set of pleats is achieved to the length of the un-pleated sections of fabric along the cross-sectional circumference of the tube.

Preferably the length of the un-pleated sections of fabric along the cross-sectional circumference of the tube and the length of the sections of fabric between parallel longitudinal folds of the sets of pleats along the cross-sectional circumference of the tube is such that in the folded state the two sets of pleats do not overlap. More preferably, in the folded state, the longitudinal folds of a first one of the sets of pleats and longitudinal folds of the other one of the sets of pleats that are adjacent are arranged close to one another. This allows for a great reduction of the size of the tube in the direction transverse to the longitudinal folds of the set of pleats without the two sets of pleats overlapping.

In a preferred embodiment of the bag according to the invention including the two sets of pleats, in the folded state, the distance between the two sets of pleats is in the range of 0 cm to 2 cm.

In an advantageous embodiment of the bag according to the invention the length of each sections of fabric between parallel longitudinal folds of the at least one set of pleats along the cross-sectional circumference of the tube is in the range of 4 cm to 6 cm. In particular in combination with the features of two sets of pleats as discussed herein above and the feature of the distance between the two sets of pleats being in the range of 0 cm to 2 cm, a bag is provided with in folded state thereof a reduction in size of the tube in the direction transverse to the longitudinal folds of the set of pleats that is suitable for carrying the bag in its folded state in a purse or a pocket of a jacket or a pair of trousers. However, other lengths of each sections of fabric between parallel folds of the at least one set of pleats along the cross-sectional circumference of the tube, may be more appropriate when other sizes of the bag in folded and/or unfolded state are required.

In an advantageous embodiment of the bag according to the invention the number of longitudinal folds of the at least one set of pleats is in the range of 5 to 7. In particular in combination with the features of two sets of pleats as discussed herein above, the feature of the length of each sections of fabric between parallel longitudinal folds of the at least one set of pleats along the cross-sectional circumference of the tube being in the range of 4 cm to 6 cm, the feature of the distance between the two sets of pleats being in the range of 0 cm to 2 cm, a bag is provided with cross-sectional dimensions of the tube in unfolded state thereof that is suitable for serving a carrier bag for products and with a reduction in size of the tube in the direction transverse to the longitudinal folds of the set of pleats in folded state that is suitable for carrying the bag in its folded state in a purse or a pocket of a jacket or a pair of trousers. However, other numbers of longitudinal folds of the at least one set of pleats, may be more appropriate when other sizes of the bag in folded and/or unfolded state are required.

In a preferred embodiment of the bag according to the invention, the sections of fabric that extend between two longitudinal folds each comprise at least three parallel transverse folds in alternating directions that extend transverse relative to the longitudinal folds, and in the folded state of the at least one set of pleats, the transverse folds of adjacent sections of fabric are arranged in a nesting relationship such that each set of nested transverse folds provide a combined transverse fold and the sets of nested transverse folds provide at least three parallel combined transverse folds in alternating directions. Thus, when the set or sets of pleats are brought in the folded state thereof, as described herein above, wherein the secured folds at the closed end of the tube provide guidance when folding the fabric of the tube in accordance with the longitudinal fold pattern, transverse folds in the fabric are arranged in at least three parallel combined transverse folds in alternating directions that guide further folding of the tube in accordance with a transverse fold pattern. Because the transverse folds are combined into combined transverse folds, even if a single transverse fold over time becomes less well defined, the other transverse folds that together with said less well defined fold form a combined transverse fold ensure that the less well defined fold is also folded in accordance with the original transverse fold pattern. Again, preferably the transverse folds comprise set folds, more preferably heat-set folds and/or chemically-set folds.

The thus provided transverse fold pattern, provides for a reduction of the size of the tube of the bag according to the invention in longitudinal direction. In a preferred embodiment the at least three parallel combined transverse folds in alternating directions are arranged such that in a further folded state of the at least one set of pleats, the sections of fabric on opposite sides of each combined transverse folds are arranged the one on top of the other. This reduces the size of the tube in the further folded state of the set or sets of pleats in the longitudinal direction of the tube to the largest distance between two parallel combined transverse folds.

In an advantageous embodiment of the bag according to the invention with transverse folds, the number of parallel combined transverse folds is in the range of 6 to 8. This allows for a suitable longitudinal size of the tube for use of the bag according to the invention in its unfolded state for carrying products, in combination with a suitable size of the tube in the longitudinal direction thereof for carrying the bag in its folded state in a purse or in a pocket of a jacket or a pair of trousers.

In an advantageous embodiment of the bag according to the invention with transverse folds, the distance between each two parallel combined transverse folds is substantially the same. Preferably the distance is in the range of 5.5 cm to 10 cm, more preferably 6 cm to 8 cm.

In a further advantageous embodiment of the bag according to the invention with a tube having a closed end and an open end that is provided with at least one handle for carrying the bag, the at least one handle is provided by two strips of fabric extending from the open end of the tube that are connected at the ends thereof that are opposite the open end of the tube. Preferably the two strips of fabric are provided by an extension of two of the sections of fabric of the at least one set of pleats.

In a preferred embodiment of the hag according to the invention with a tube having a closed end and an open end that is provided with at least one handle for carrying the bag and as an advantageous alternative embodiment of the above described bag wherein the at least one handle is provided by two strips of fabric extending from the open end of the tube, the at least one handle is provided by a handle opening in the fabric of the tube at the open end of the tube. In a preferred embodiment thereof a handle plate is arranged on the fabric around the handle opening for reinforcing the handle opening. Such a handle plate also provides weight that when the tube is suspended from its closed end with the open end pointing downwards, help to pull the set or sets of pleats into the folded state thereof along the length of the tube from the closed end to the open end. The handle plate can be made of a synthetic material and can be rigid or flexible.

In an advantageous embodiment thereof, in combination with the features of the embodiment described herein above having two sets of pleats extend from the closed end to the open end of the tube, wherein along the cross-sectional circumference of the tube the two sets of pleats are separated on either side by a respective un-pleated section of fabric that extends between the respective end folds of the sets of pleats, in each of the un-pleated sections of fabric separating the two sets of pleats a handle opening is arranged at the open end of the tube.

In an advantageous embodiment thereof in combination with the features of the embodiment described herein above wherein the sections of fabric that extend between two longitudinal folds each comprise at least three parallel transverse folds in alternating directions that extend transverse relative to the pleats, and wherein in the folded state of the at least one set of pleats, the transverse folds of adjacent sections of fabric are arranged in a nesting relationship such that each set of nested transverse folds provide a combined transverse fold and the sets of nested transverse folds provide at least three parallel combined transverse folds in alternating directions, a respective handle plate is arranged on the fabric around each handle opening and the handle plates cover the section of fabric bounded by the end folds of the two sets of pleats, the edge of the open end of the tube, and, the transverse fold in the section of fabric that is closest to the open end of the tube.

In a further advantageous embodiment of the bag according to the invention a base element is provided at the closed end of the tube.

In an advantageous embodiment thereof, in combination with the embodiment described herein above wherein the bag is provided with handle plates and parallel combined transverse folds, the at least three parallel combined transverse folds in alternating directions are arranged such that in a further folded state of the at least one set of pleats, the sections of fabric on opposite sides of each combined transverse folds are arranged the one on top of the other, and the base element is a base plate that is attached to the tube at the closed end such that in the further folded state of the at least one set of pleats, a stack of fabric sections is arranged between the base plate at one end of the stack and the handle plates at the other end of the stack.

In an advantageous embodiment thereof the base plate is attached to and covers one of the two sections of fabric bounded by the end folds of the two sets of pleats, the edge of the closed end of the tube, and the transverse fold in the section of fabric that is closest to the closed end of the tube.

In an advantageous embodiment of the bag according to the invention provided with handle plates and a base plate, at least one releasable fastener is provided for fastening the base plate to at least one of the handle plates in the further folded state of the at least one set of pleats. Such fastener, for instance one or more magnets or a binder, allows for holding the bag in its folded state.

Although embodiments of a bag according to the present invention are particularly suitable as a carrier bag for use during shopping, embodiments of a bag according to the invention can be used for carrying all sorts of items.

BRIEF DESCRIPTION OF THE FIGURES

The accompanying figures are used to illustrate non-limitative preferred exemplary embodiments of the present invention. The above stated and other advantages, features and objectives of the invention will become more apparent, and the invention better understood, from the following detailed description when read in combination with the accompanying schematic figures, wherein:

FIGS. 4A to 4C show the bag according to the first embodiment shown in FIGS. 1 and 2A to 2G with the sets of pleats in their unfolded state, folded state, and further folded state, respectively:

DETAILED DESCRIPTION OF THE FIGURES

Figure 1:
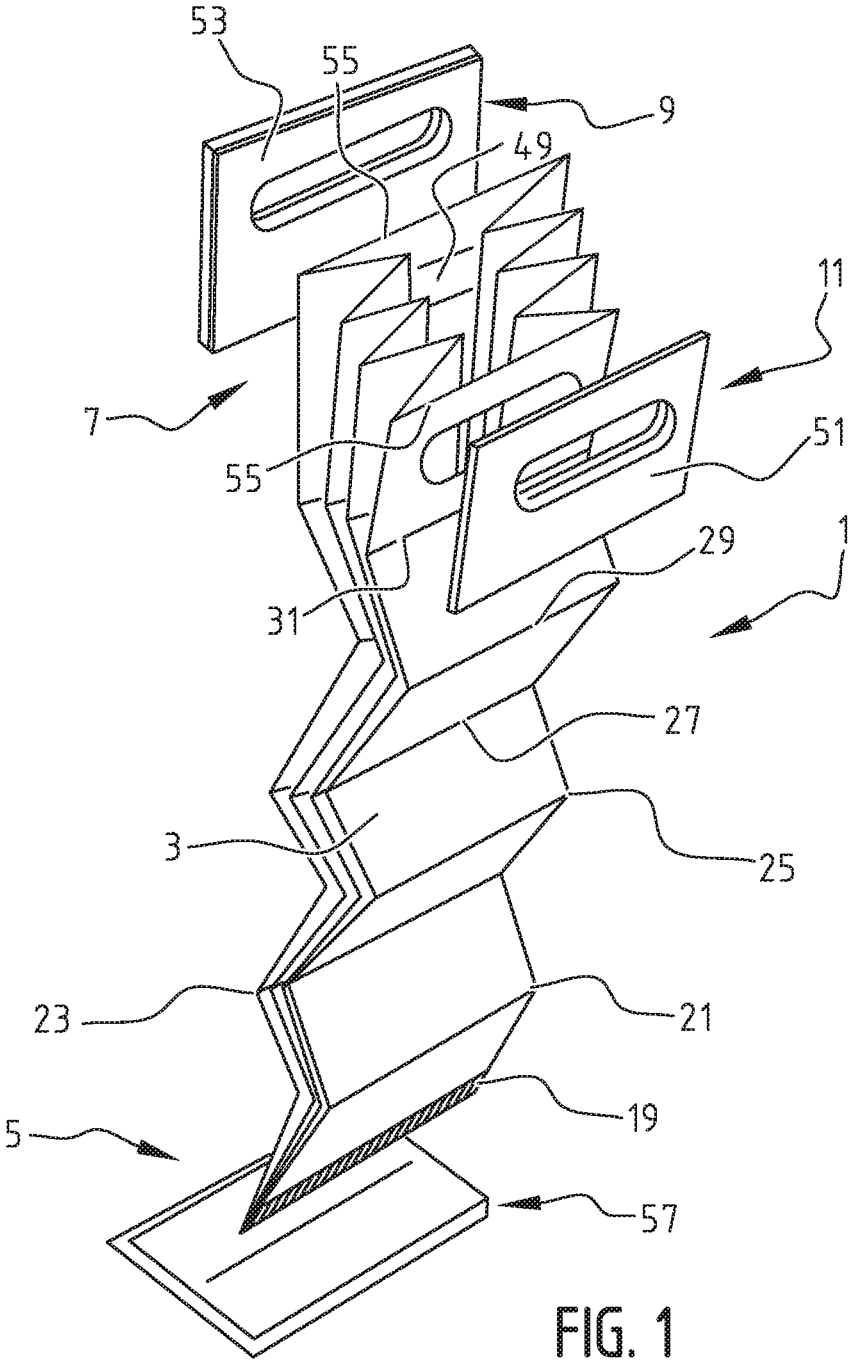
FIG. 1 shows an exploded, perspective view of a first embodiment of the bag according to the invention.

In FIGS. 1 and 2 a preferred embodiment is shown of the bag according to the present invention.

The bag 1 comprises a tube 3 having a closed end 5 and an open end 7. The open end 7 is provided with two handles 9, 11 for carrying the bag 1. The tube 3 is made of a pleatable fabric, in particular polyester organza. The tube comprises two sets 13, 15 of pleats that extend from the closed end 5 to the open end 7 of the tube 3. Each set 13, 15 of pleats comprises seven parallel longitudinal folds 13*a* to 13*g*, 15*a* to 15*g* in alternating directions that extend from the closed end 5 to the open end 7 of the tube 3. Each set 13, 15 of pleats is secured in place at the closed end 5 of the tube 3 in a folded state wherein the sections 17*a* to 17*n* of fabric on opposite sides of each longitudinal fold 13*a* to 13*g*, 15*a* to 15*g* are arranged the one on top of the other. The pleats of the shown sets 13, 15 of pleats are known in the field as accordion pleats.

Figure 2A:
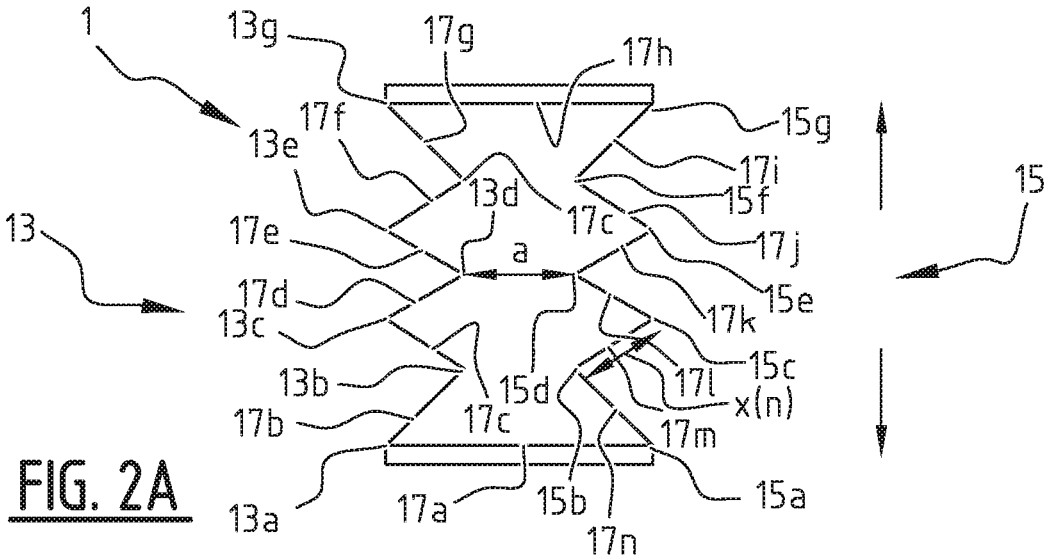
FIG. 2A to 2G show the embodiment of FIG. 1 in different views in different phases of folding the bag.

As shown in FIG. 1 and in particular in the cross-section of the tube 3 shown in FIG. 2A, along the cross-sectional circumference of the tube 3 the two sets 13, 15 of pleats are separated on either side by a respective un-pleated section 17*a*, 17*h* of fabric that extends between the respective longitudinal end folds 13*a*, 15*a*, 13*g*, 17*g* of the sets 13, 15 of pleats. In particular a first un-pleated section 17*a* extends between the end folds 13*a* and 15*a*, and a second un-pleated section 17*h* extends between the end folds 13*g* and 15*g*.

As shown in FIGS. 1 and 2, the sections 17*a* to 17*n* of fabric that extend between two longitudinal folds 13*a* to 13*g*, 15*a* to 15*g* each comprise seven parallel transverse folds 19, 21, 23, 25, 27, 29, and 31 in alternating directions that extend transverse relative to the longitudinal folds 13*a* to 13*g*, 15*a* to 15*g* of the sets 13, 15 of pleats. In FIG. 1 and FIG. 2C the sets 13, 15 of pleats are in a folded state at the closed end 5 of the tube 3, and in a partly unfolded state at the open end 7 of the tube 3. In FIG. 2D the sets 13, 15 of pleats are in a folded state along the full length of the longitudinal folds 13*a* to 13*g*, 15*a* to 15*g* from the closed end 5 to the open end 7 of the tube 3. As shown in FIG. 2C, in the folded state of the sets 13, 15 of pleats, the transverse folds of adjacent sections 17*a* to 17*n* of fabric are arranged in a nesting relationship such that each set of nested transverse folds provide a respective combined transverse fold 19, 21, 23, 25, 27, 29, and 31. In particular, the sets of nested transverse folds provide seven parallel combined transverse folds 19, 21, 23, 25, 27, 29, and 31 in alternating directions.

Figure 2B:
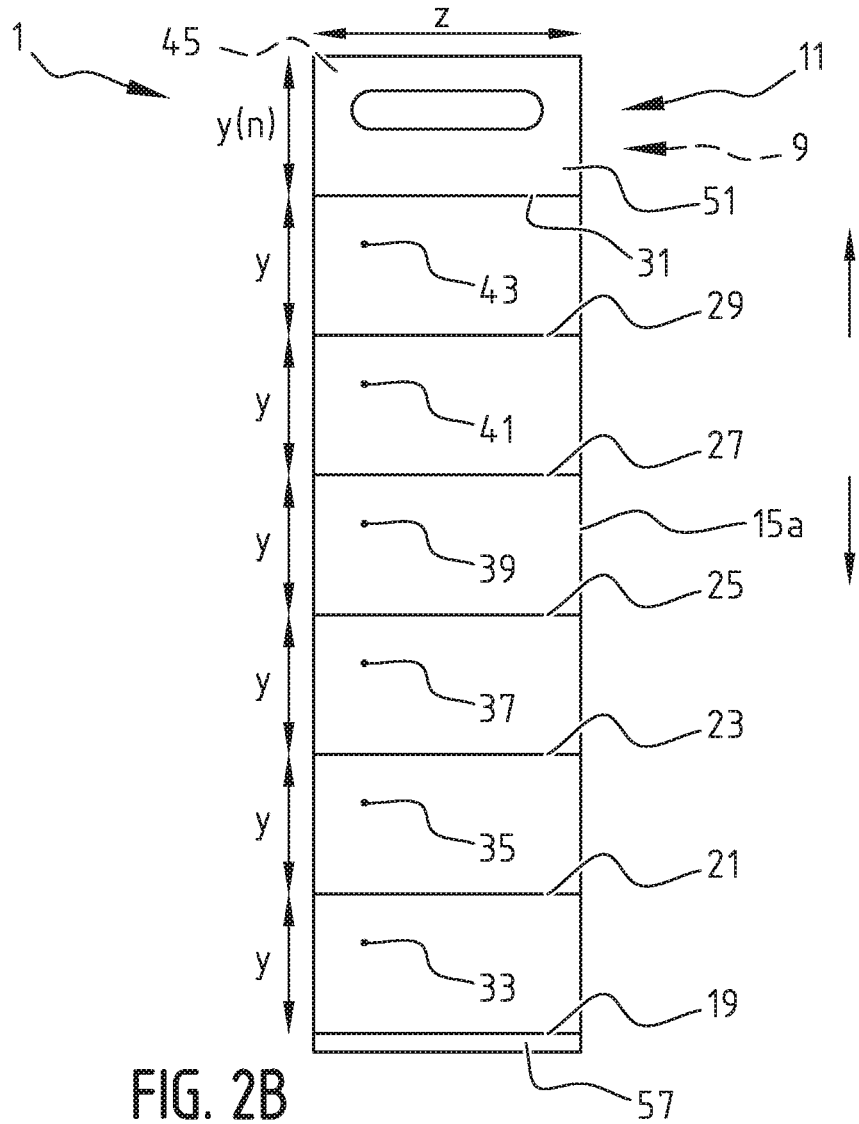
Figures 2C, 2D, 2E, 2F:
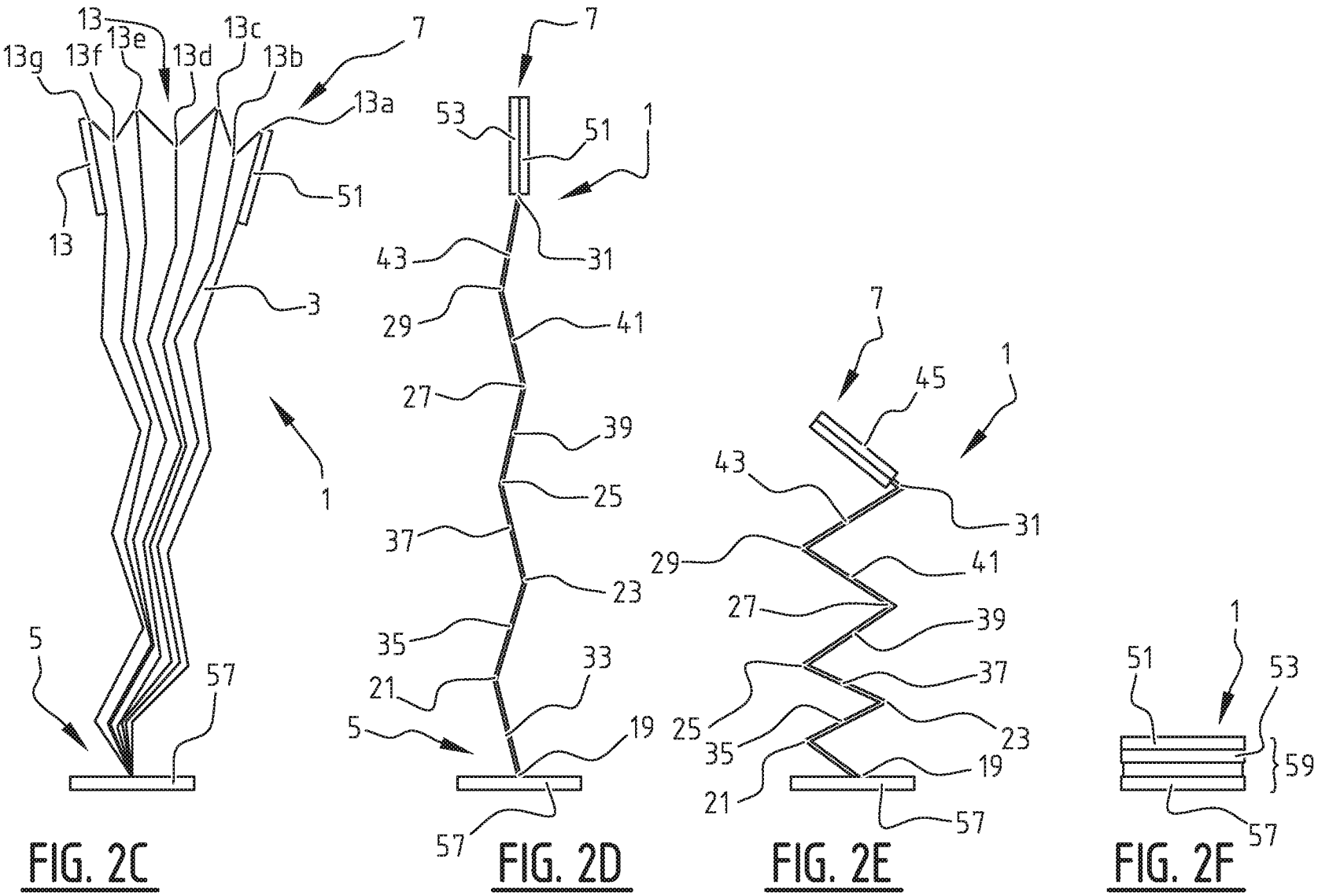

As shown in FIG. 2D, in the folded state of the sets 13, 15 of pleats, the transverse folds of adjacent sections 17*a* to 17*n* of fabric are arranged in a nesting relationship such that each set of nested transverse folds provide a respective combined transverse fold 19, 21, 23, 25, 27, 29, and 31. In particular, the sets of nested transverse folds provide seven parallel combined transverse folds 19, 21, 23, 25, 27, 29, and 31 in alternating directions.

In FIG. 21, the sets 13, 15 of pleats are in a folded state along the full length of the longitudinal folds 13*a* to 13*g*, 15*a* to 15*g* from the closed end 5 to the open end 7 of the tube 3, while the combined transverse folds 19, 21, 23, 25, 27, 29, and 31 are in an unfolded state. From the state shown in FIG. 2D, the sets 13, 15 of pleats can be brought, via the state shown in FIG. 2E, in a further folded state shown in FIG. 2F wherein the sections 33, 35, 37, 39, 41, 43, 45 of fabric on opposite sides of each combined transverse folds 19, 21, 23, 25, 27, 29, and 31 are arranged the one on top of the other.

Figure 2G:
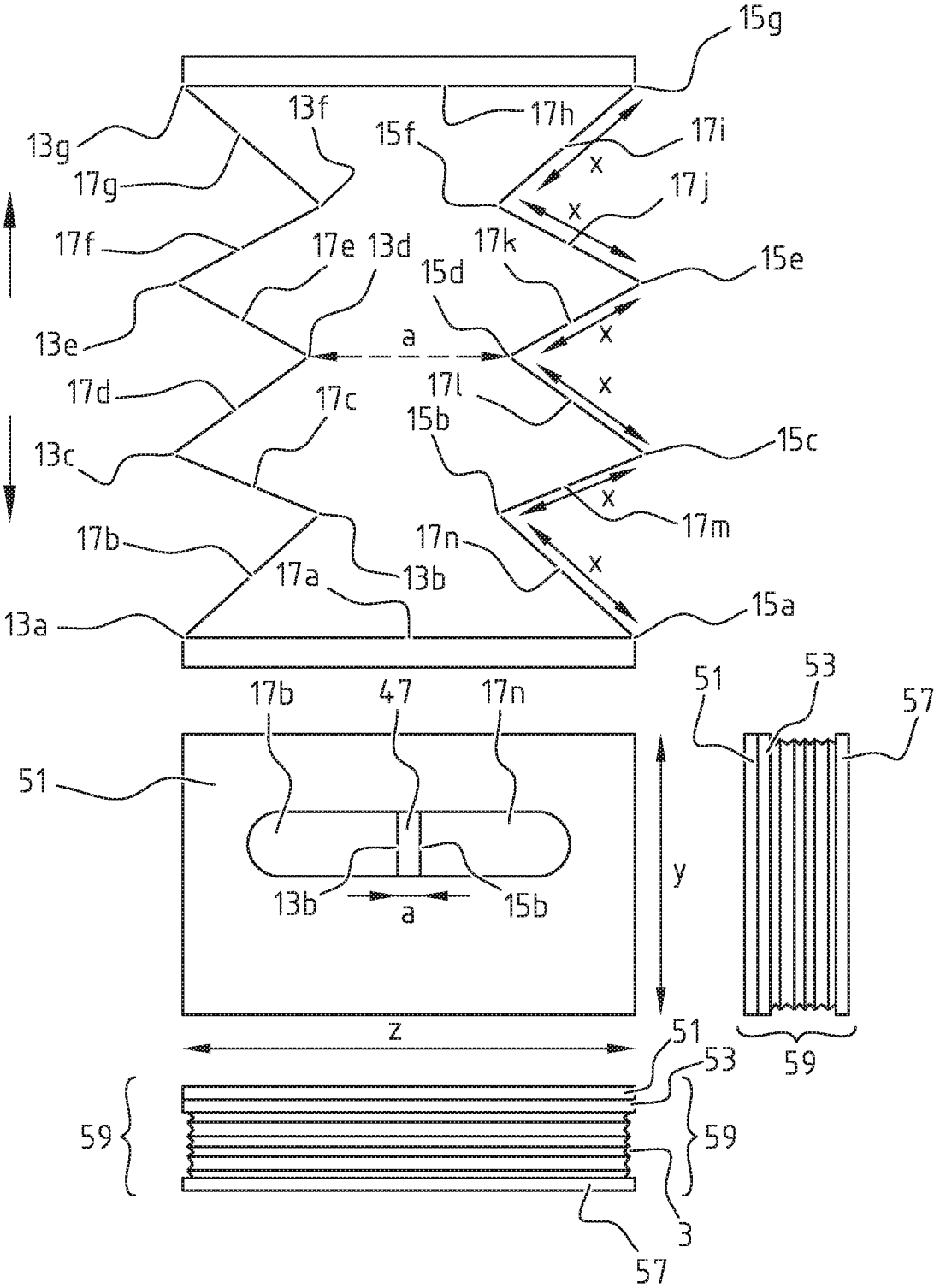

Referring to FIGS. 2A, 2B and 2G the length z of the un-pleated sections 17*a*, 17*h* of fabric along the cross-sectional circumference of the tube 3 and the length x of the sections 17*b* to 17*g* and 17*i* to 17*n* of fabric between parallel longitudinal folds 13*a* to 13*g*, 15*a* to 15*g* of the sets 15, 17 of pleats along the cross-sectional circumference of the tube 3 are such that in the folded state of the sets 13, 15 of pleats the two sets of pleats do not overlap. In particular is shown in FIG. 2F that in the folded state of the sets 13, 15 of pleats, there is a distance a between the two sets 13, 15 of pleats. The length z of the un-pleated sections 17*a*, 17*h* of fabric along the cross-sectional circumference of the tube 3 is thus two times the length x of the sections 17*b* to 17*g* and 17*i* to 17*n* of fabric between parallel longitudinal folds 13*a* to 13*g*, 15*a* to 15*g* of the sets 15, 17 of pleats along the cross-sectional circumference of the tube 3, plus the distance a. In the shown preferred embodiment the length x is 5 cm and the length z is 1 cm, such that the distance a is 1 cm. The distance y between each two parallel combined transverse folds 21, 23, 25, 27, 29, and 31 is substantially the same. In the shown preferred embodiment the distance y is 7 cm. The distance y' between the two parallel combined transverse folds 19 and 21 is smaller to allow the closed end 5 of the tube to be attached to the base plate 57 along a line at a location in between opposite edges of the base plate 57 while allowing the combined transverse fold 21 to be situated along the edge of the base plate 57 in the further folded state of the sets of pleats as shown in FIG. 2F. In particular, in the shown embodiment the distance y' is about half the distance y. However, the distance y' can be other than about half the distance y.

Figure 3A:
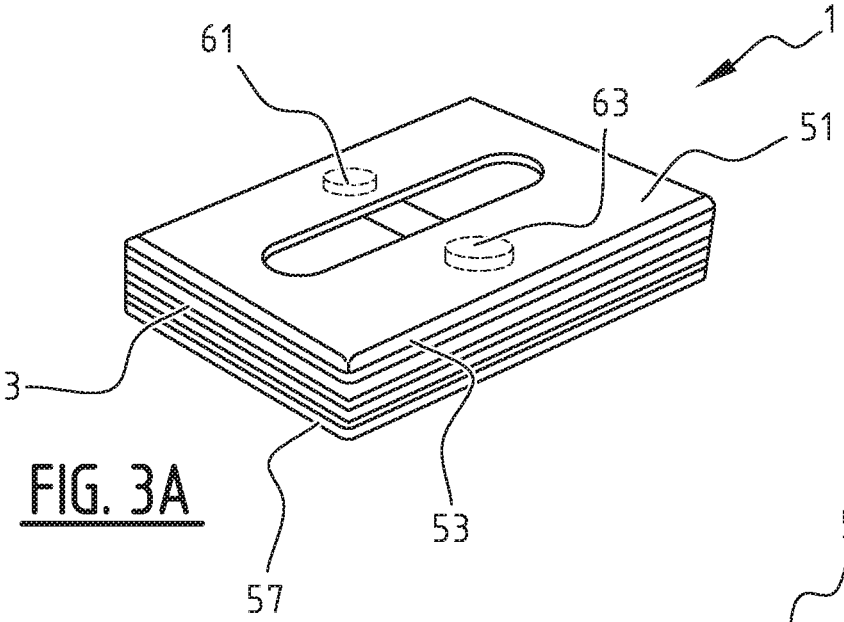
FIGS. 3A and 3B show two alternative embodiments of means for holding the folded bag of the first embodiment of FIGS. 1 and 2A to 2G together.
Figure 3B:
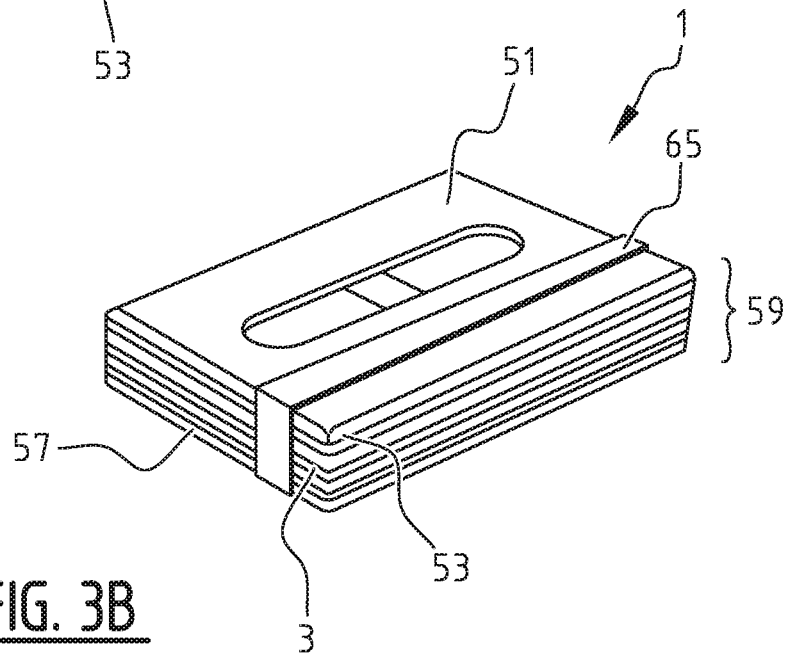

Referring to FIG. 1 and FIGS. 2A to 2G, the handles 9, 11 are provided by a respective handle opening 47, 49 in each of the un-pleated sections 17*a*, 17*h* of fabric separating the two sets 13, 15 of pleats at the open end 7 of the tube 3. On the fabric around each handle opening 47, 49 is arranged a respective handle plate 51, 53 for reinforcing the respective handle opening 47, 49. Each handle plate 51, 53 covers a section of fabric hounded by the end folds 13*a*, 15*a*, 13*g*, 15*g* of the two sets 13, 15 of pleats, the edge 55 of the open end 7 of the tube 3, and, the transverse fold 31 in the section of fabric that is closest to the open end 7 of the tube 3. A base element embodied by a base plate 57 is provided at the closed end 5 of the tube 3. The base plate 57 is attached to the tube 3 at the closed end 5 such that, as shown in FIG. 2F, in the further folded state of the sets 13, 15 of pleats, a stack 59 of fabric sections is arranged between the base plate 57 at one end of the stack 59 and the handle plates 51, 53 at the other end of the stack 59. As illustrated by means of FIG. 3A, in which an embodiment of the stack 59 of fabric sections of FIG. 2F is shown, the bag 1 can comprise releasable fasteners embodied by magnets 61, 63 for fastening the base plate 57 to the handle plates 51, 53 and for fastening the one of the handle plates to the other in the further folded state of the sets 13, 15 of pleats. In FIG. 3B an alternative releasable fastener is shown that is embodied by a binder 65.

Figure 4A:
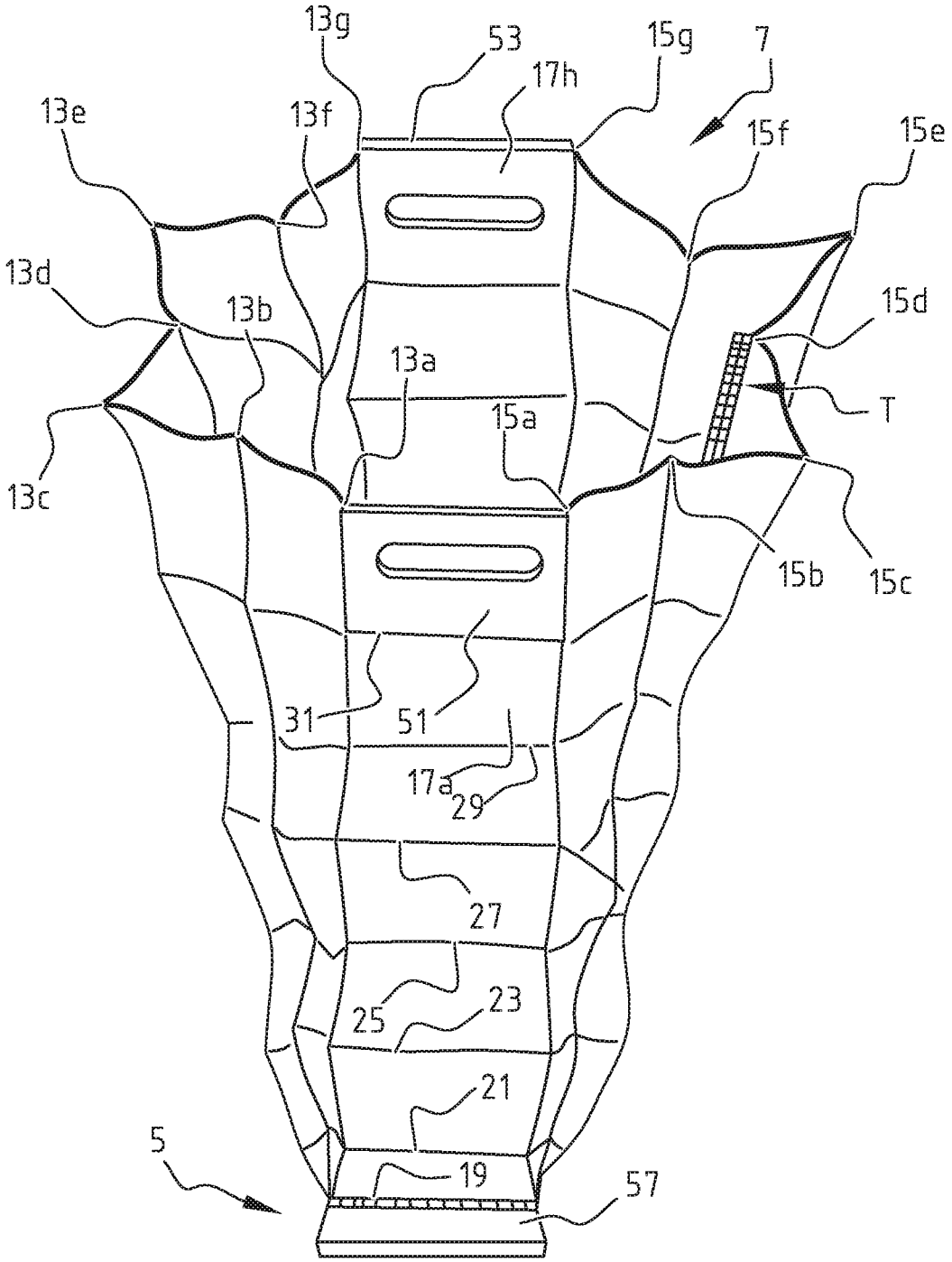
Figure 5:
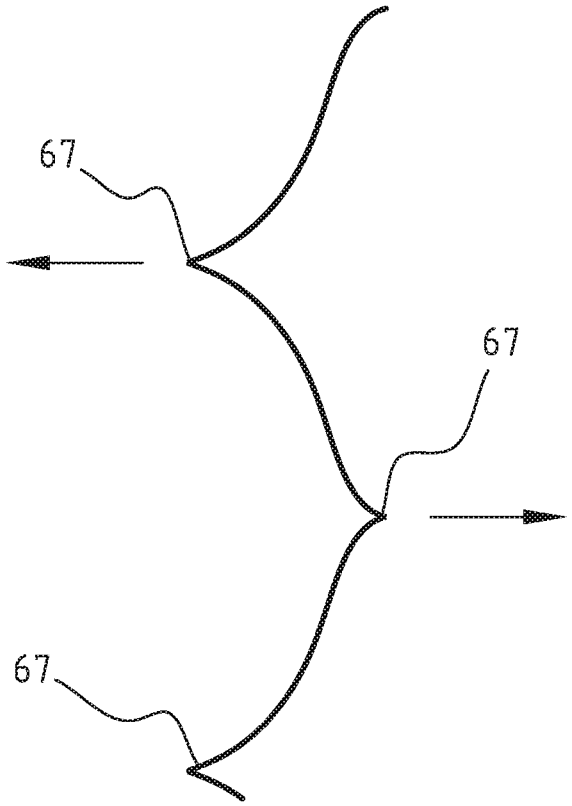
FIG. 5 shows a detailed view of set folds of the bag according to the first embodiment shown in FIGS. 1 and 2A to 2G.

In FIG. 4Aa the bag 1 of FIGS. 1 to 3 is shown in an unfolded state. In the unfolded state of the bag 1 shown in FIG. 4A, the sets 13, 15 of pleats are in an unfolded state at the open end 7 of the tube 3 and are in a folded state at the closed end 5 of the tube 3, and the transverse folds 19, 21, 23, 25, 27, 29, and 31 are in their unfolded state. As shown in FIG. 4A, the longitudinal folds 13*a* to 13*g*, and 15*a* to 15*g*, as well as the transverse folds 19, 21, 23, 25, 27, 29, and 31 are clearly visible and well defined. This is because the folds are so-called set folds, in the present preferred embodiment in particular heat-set folds except for the longitudinal fold 15*d*. The longitudinal fold 15*d* is a mechanically set fold, wherein the two sections on opposite sides of the fold are sewn together using thread 'T' to form a set fold. In FIG. 5 such heat-set or mechanically-set folds 67 are shown in more detail in the unfolded state of the bag 1 of FIG. 4A. As shown, although the sections of fabric on opposite sides of each of the set folds 67 are unfolded in the sense that the sections are not fully arranged the one on top of the other, near the folds 67 the sections are still in a substantially folded state. As a result, once the force that caused the sections to be moved away from each other is released, the sections of fabric on opposite sides of a fold 67 tend to return to the folded state wherein the sections are arranged the one on top of the other. The sections of fabric on opposite sides of a fold 67 in particular tend to return to the folded state wherein the sections are arranged the one on top of the other when the sections are additionally stimulated to return to the folded state.

In case the bag 1 as shown in FIG. 1 is suspended from its base plate 57 at the closed end 5 of the tube 3 with the open end 7 pointing downwards, as shown in FIG. 4B, the two sets 13, 15 of pleats return to their folded state along the full length of the longitudinal folds 13*a* to 13*g*, and 15*a* to 15*g*, as a result of the longitudinal folds 13*a* to 13*g*, and 15*a* to 15*g* being set folds and as a result of the longitudinal folds

13*a* to 13*g* folds being secured in their folded state to the base plate 57. The returning of the two sets 13, 15 of pleats to their folded state along the full length of the longitudinal folds 13*a* to 13*g*, and 15*a* to 15*g*, is stimulated by the force of gravity that pulls on the fabric and the handle plates 51, 53. The amount of stimulation by the force of gravity depends on the weight of the fabric and the weight of the handle plates 51, 53. Once the two sets 13, 15 of pleats are thus returned into their folded state, as shown in FIG. 5, while the bag 1 is suspended from its base plate 57 at the closed end 5 of the tube 3 with the open end 7 pointing downwards, the two sets 13, 15 of pleats can be brought into their further folded state by moving the base plate 51 towards the handle plates 51, 53 while maintaining the vertical orientation of the bag 1. The set transverse folds 19, 21, 23, 25, 27, 29, and 31 thereby cause the sections of fabric on opposite sides of each of the transverse folds to return to the further folded state of the two sets 13, 15 of pleats, such that the stack 59 of fabric sections, handle plates 51, 53, and base plate 57 results that is shown in FIG. 4C.

Figure 6A:
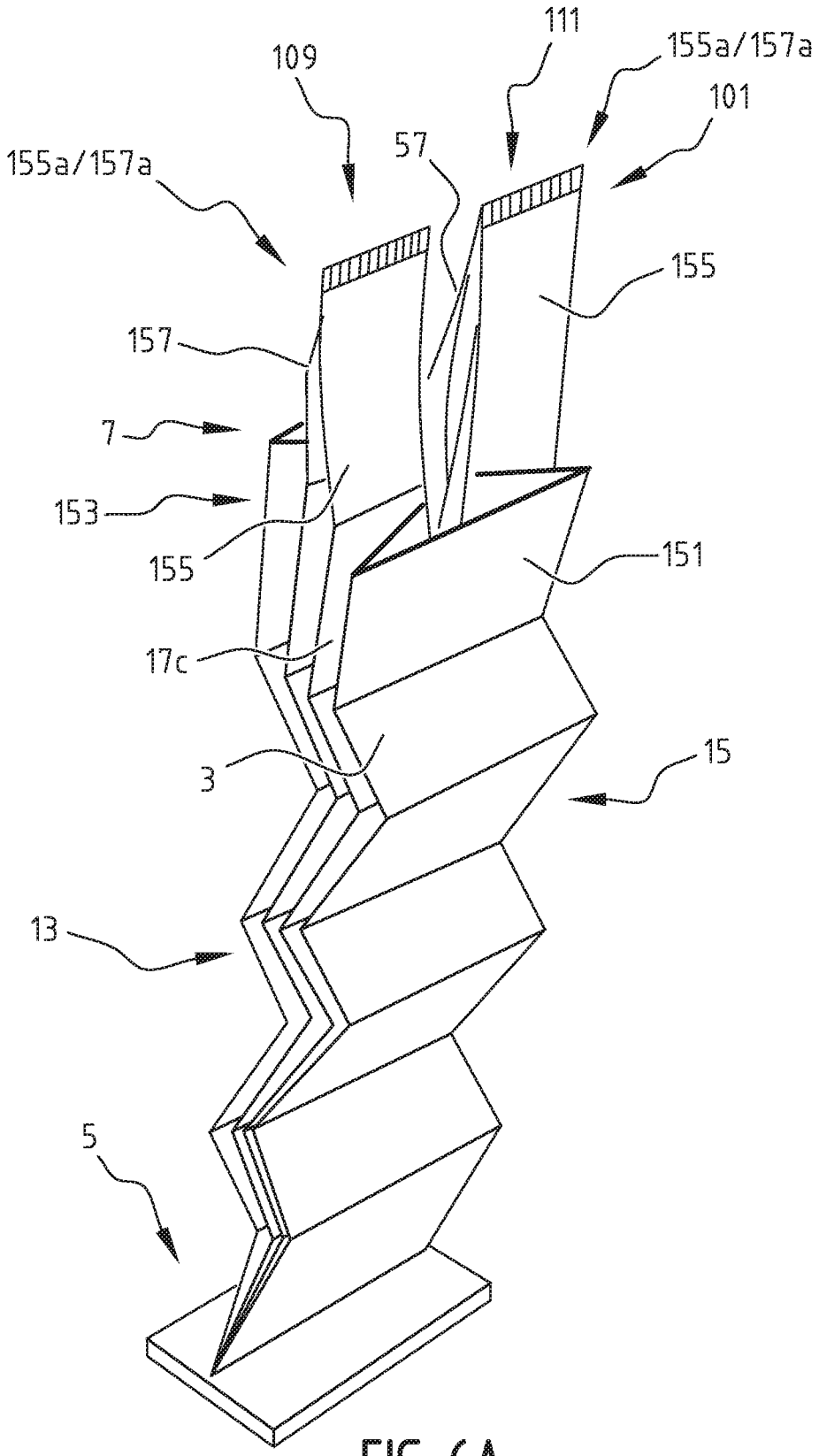
FIGS. 6A and 6B show a perspective view of a second embodiment of the bag according to the invention with the sets of pleats in their unfolded state and folded state, respectively.
Figure 6B:
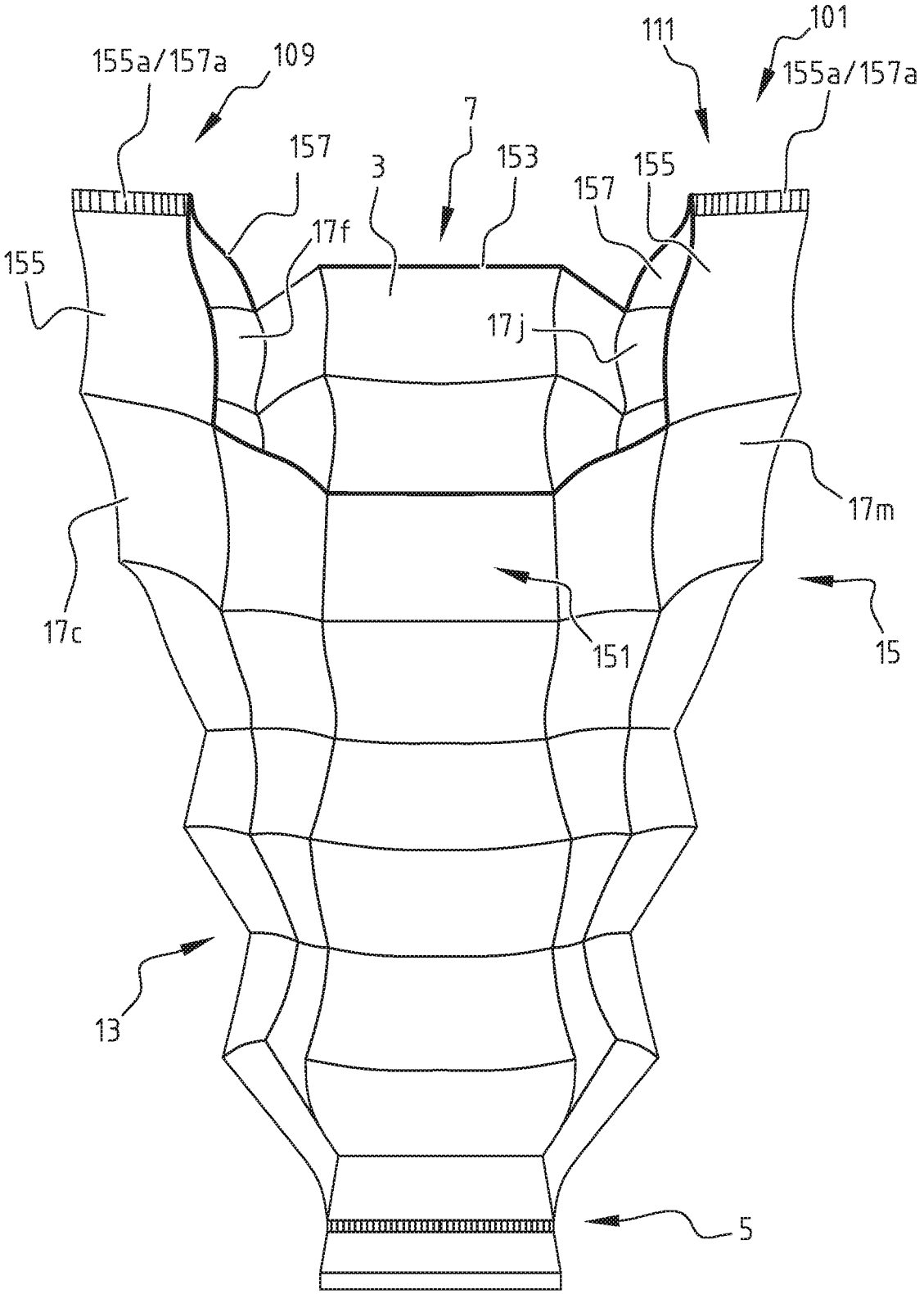

In FIGS. 6A and 6B an alternative embodiment is shown of the bag 1 as shown in FIGS. 1 to 5. Bag 101 shown in FIGS. 6A and 6B corresponds to the bag 1 of FIGS. 1 to 5 except for the handles. In the bag 101 each handle 109, 111 is provided by two strips 155, 157 of fabric extending from the open end 7 of the tube 3 that are mutually connected at the ends 155*a*, 157*a* thereof that are opposite the open end 7 of the tube 3. The two strips 155, 157 of fabric are provided by an extension of two of the sections 17*c*, 17*f*; 17*j*, 17*m* of fabric of a respective one of the two sets 13, 15 of pleats. In stead of the handle plates 51, 53, plate 151 is provided and, optionally plate 153.

Figure 7C:
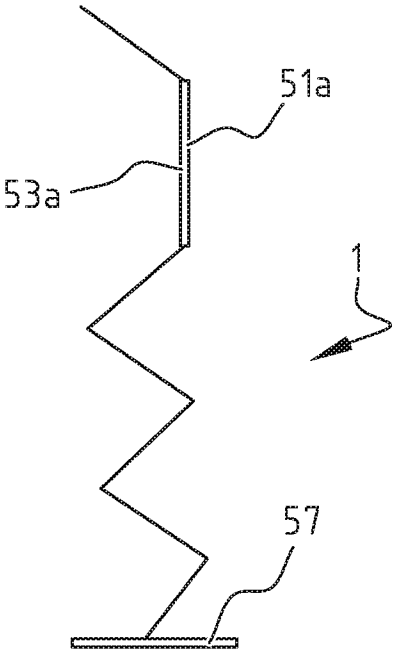
FIGS. 7A to 7C show in side view three alternative embodiments of the bag according to the invention based on the first and second embodiment shown in FIGS. 1 to 6.
Figure 7B:
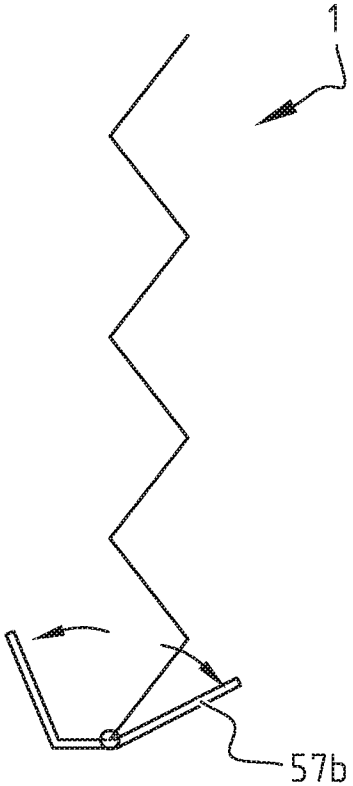
Figure 7A:
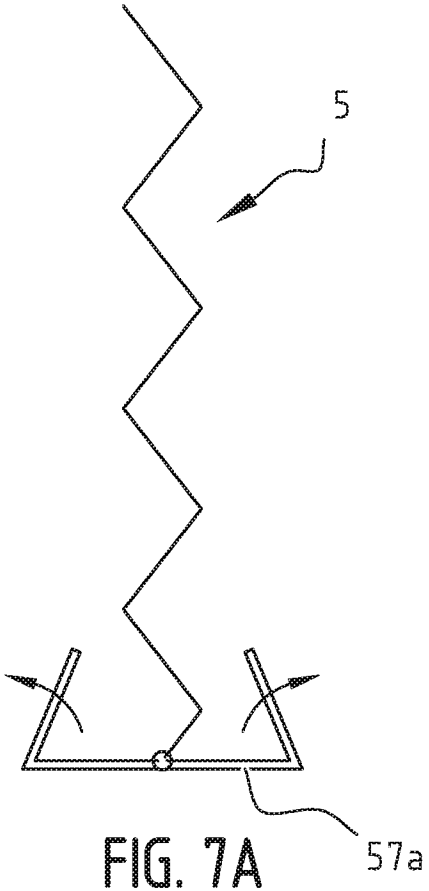

In the FIGS. 1 to 6 two embodiments of a bag according to the invention are shown with a base plate 57 at the closed end of the tube and one or more (handle)plates 51, 53, 151, 153 at the open end of the tube. In FIGS. 7A and 7B two alternative embodiments are shown without (handle) plates near the open end and with a base plate of an alternative design. In the embodiments shown in FIGS. 7A and 7B the base plate 57*a*, 57*b* have a plurality of parts that are hingedly connected. In FIGS. 7A and 7B is shown that two hinged parts that are rotated relative to a central part in the direction of the showed arrows to unfold the base plate 57*a*. 57*b*. After unfolding, the fabric sections can be folded according to the combined transverse folds in a stack of fabric sections onto the base plate 57*a*, 57*b*. By subsequently rotating the hinged parts in a direction opposite to the shown arrows, the hinged parts can be folded onto the stack of fabric sections such that the fabric sections are arranged between and enclosed by base plate parts.

In the FIGS. 1 to 6 two embodiments of a bag according to the invention are shown with are shown with a base plate 57 at the closed end of the tube and one or more (handle) plates 51, 53, 151, 153 at the open end of the tube, wherein in particular the (handle)plates are arranged between the edge of the open end of the tube and the first combined transverse fold counted from the open end. In FIG. 7C an alternative embodiment is shown wherein plates 51*a*, 53*a* are arranged on the tube between the first and the second combined transverse folds counted from the top. As a further alternative the plates 51*a*, 53*a* may be arranged on the tube between two other folds the one subsequent to the other.

In the figures two embodiments of a bag according to the invention are shown each having a tube comprising two sets of pleats. In an alternative embodiment, one of the sets of pleats is replaced by a single longitudinal fold. In such alternative embodiment the tube comprises only one set of pleats.

In the figures two embodiments of a bag according to the invention are shown each having a tube comprising a set of pleats having seven parallel longitudinal folds. Alternatively, a set of pleats of an embodiment of a bag according to the invention has less, but at least three, or more longitudinal folds, such as, but not limited to, three, five, nine, eleven, or even more folds.

In the figures two embodiments of a bag 1 according to the invention are shown each having a tube 3 comprising in addition to longitudinal folds, seven combined transverse folds. Alternatively, an embodiment of a bag according to the invention has less or more combined transverse folds, such as, but not limited to, three, four, five, six, seven, eight, nine, ten, eleven, twelve, or even more folds. As a further alternative it would be possible that an embodiment of a bag according to the invention has only longitudinal folds and no combined transverse folds. In such embodiment after bringing the sets of pleats in the folded state like in FIGS. 2D and 4B, the tube can be rolled up in stead of further folded along transverse folds.

In the figures two embodiments of a bag 1 according to the invention are shown each having (handle) plates at the open end of the tube. Alternatively, an embodiment of the bag according to the invention has no such (handle) plates.

In the figures two embodiments of a bag according to the invention are shown wherein the closed end of the tube is attached to the base plate along a line halfway the base plate. Alternatively, the closed end of the tube is attached to the base plate along an edge of the base plate. In such embodiment the distance between each two parallel combined transverse folds may be substantially the same.

In the figures two embodiments of a bag 1 according to the invention are shown wherein the tube 3 is provided at its open end with handles. Alternatively the bag according to the invention does not have any handles. In case there are no handles, plates may still advantageously provided at the open end of the tube at or near the location of the handles plates to provide a weight that helps to pull the pleats into the folded state and that helps to bring the transverse folds together to form the combined transverse folds under influence of gravity when the tube is suspended from its closed end. Furthermore, such plates provide together with the base plate protective end faces of the stack of fabric sections as shown in FIG. 2F.

Although the principles of the invention have been set forth above with reference to specific embodiments, it must be understood that this description is given solely by way of example and not as limitation to the scope of protection, which is defined by the appended claims.

The invention claimed is:

1. A bag, comprising a tube having a closed end and an open end, wherein:

the tube is made of a fabric;

the tube comprises at least one set of pleats;

the at least one set of pleats comprises at least five parallel longitudinal folds in alternating directions that extend from the closed end to the open end of the tube; and the longitudinal folds of the at least one set of pleats are secured in place at the closed end of the tube, wherein the sections of fabric on opposite sides of each longitudinal fold are the one on top of each other in a folded state of the at least one set of pleats, the tube is provided at the open end thereof with at least one handle for carrying the bag; and the at least one handle is provided by a handle opening in the fabric of the tube at the open end of the tube, a handle plate is arranged on the fabric around the handle opening for reinforcing the handle opening, two sets of pleats extend from the closed end to the open end of the tube;

along the cross-sectional circumference of the tube the two sets of pleats are separated on either side by a respective un-pleated section of fabric that extends between the respective end folds of the sets of pleats;

in each of the un-pleated sections of fabric separating the two sets of pleats a handle opening is arranged at the open end of the tube, the sections of fabric that extend between two longitudinal folds each comprise at least three parallel transverse folds in alternating directions that extend transverse relative to the pleats;

in the folded state of the at least one set of pleats, the transverse folds of adjacent sections of fabric are arranged in a nesting relationship such that each set of nested transverse folds provide a combined transverse fold and the sets of nested transverse folds provide at least three parallel combined transverse folds in alternating directions;

a respective handle plate is arranged on the fabric around each handle opening; and the handle plates cover the section of fabric bounded by the end folds of the two sets of pleats, the edge of the open end of the tube, and, the transverse fold in the section of fabric that is closest to the open end of the tube.

2. The bag according to claim 1, wherein the fabric has a weight that is such that when the tube is suspended from its closed end with the open end pointing downwards, the at least one set of pleats is pulled under influence of gravity into its folded state along a length of the tube from the closed end to the open end.

3. The bag according to claim 1, wherein the length of the un-pleated sections of fabric along the cross-sectional circumference of the tube and the length of the sections of fabric between parallel folds of the sets of pleats along the cross-sectional circumference of the tube is such that in the folded state the two sets of pleats do not overlap.

4. The bag according to claim 3, wherein, in the folded state, the distance between the two sets of pleats is in the range of 0 cm to 2 cm, wherein the length of each sections of fabric between parallel folds of the at least one set of pleats along the cross-sectional circumference of the tube is in the range of 4 cm to 6 cm, and wherein the number of longitudinal folds of the at least one set of pleats is in the range of 5 to 7.

5. The bag according to claim 1, wherein the at least three parallel combined transverse folds in alternating directions are arranged such that in a further folded state of the at least one set of pleats, the sections of fabric on opposite sides of each combined trans folds are arranged the one on top of the other.

6. The bag according to claim 1, wherein the number of parallel combined transverse folds is in the range of 6 to 8, and wherein the distance between each two parallel combined transverse folds is substantially the same, wherein preferably the distance is in the range of 6 cm to 8 cm.

7. The bag according to claim 1, wherein:

the at least one handle is provided by two strips of fabric extending from the open end of the tube that are connected at the ends thereof that are opposite the open end of the tube;

wherein the two strips of fabric are provided by an extension of two of the sections of fabric of the at least one set of pleats.

8. The bag according to claim 1, wherein a base element is provided at the closed end of the tube.

9. The bag according to claim 8, wherein:

the at least three parallel combined transverse folds in alternating directions are arranged such that in a further folded state of the at least one set of pleats, the sections of fabric on opposite sides of each combined transverse folds are arranged the one on top of the other; and the base element is a base plate that is attached to the tube at the closed end such that in the further folded state of the at least one set of pleats, a stack of fabric sections is arranged between the base plate at one end of the stack and the handle plates at the other end of the stack.

10. The bag according to claim 9, wherein the base plate is attached to and covers one of the two sections of fabric bounded by the end folds of the two sets of pleats, the edge of the closed end of the tube, and the transverse fold in the section of fabric that is closest to the closed end of the tube.

11. The bag according to claim 9, further comprising at least one releasable fastener for fastening the base plate to at least one of the handle plate in the further folded state of the at least one set of pleats.

12. The bag according to claim 1, wherein the at least one set of pleats comprises accordion pleats, and wherein the folds comprise set folds.

13. The bag according to claim 12, wherein the set folds are at least one of heat-set folds, chemically-set folds, or mechanically-set folds, and wherein the fabric is suitable for at least one of heat-setting of folds, chemically-setting of folds, or mechanically setting of folds.

14. The bag according to claim 1, wherein the fabric is organza.

15. The bag according to claim 1, wherein the bag comprises a plate on one of the open end and the closed end.

16. The bag according to claim 1, wherein the bag comprises a base plate near the closed end and at least one further plate near the open end.

* * * * *